US012239212B2

(12) United States Patent
Yeates

(10) Patent No.: US 12,239,212 B2
(45) Date of Patent: Mar. 4, 2025

(54) HANDS-FREE CARRYING DEVICE

(71) Applicant: William Yeates, Minneola, FL (US)

(72) Inventor: William Yeates, Minneola, FL (US)

( * ) Notice: Subject to any disclaimer, the term of this patent is extended or adjusted under 35 U.S.C. 154(b) by 36 days.

(21) Appl. No.: 17/971,275

(22) Filed: Oct. 21, 2022

(65) Prior Publication Data

US 2024/0130511 A1 Apr. 25, 2024
US 2024/0225249 A9 Jul. 11, 2024

(51) Int. Cl.
*A47D 13/02* (2006.01)
*A45F 5/00* (2006.01)

(52) U.S. Cl.
CPC ..... *A45F 5/00* (2013.01); *A47D 13/02* (2013.01); *A45F 2005/008* (2013.01)

(58) Field of Classification Search
CPC ..... A41D 13/08
USPC ..... 224/222, 267; 2/16
See application file for complete search history.

(56) References Cited

U.S. PATENT DOCUMENTS 4,120,052 A * 10/1978 Butler ..... A41D 13/065 2/24
D300,676 S * 4/1989 Pierce, Jr. ..... D29/120.1
5,647,062 A * 7/1997 Nigbur ..... A41D 13/08 2/16
5,715,535 A * 2/1998 Hamilton ..... A41D 13/08 2/46
5,722,092 A * 3/1998 Borzecki ..... A41D 13/088 2/161.1
5,865,775 A * 2/1999 Peoples ..... A61F 5/0118 602/62
6,076,185 A * 6/2000 Schramm ..... A41D 13/0568 2/455
8,851,342 B2 * 10/2014 Carbone ..... A47D 13/02 224/267
9,021,663 B2 * 5/2015 Maudsley ..... A45F 5/10 16/901
9,038,245 B2 * 5/2015 Owens ..... A45F 5/10 16/430
9,345,291 B2 * 5/2016 Brenner ..... A44C 5/0007
10,149,553 B1 * 12/2018 Carbone ..... A47D 13/02
2012/0175920 A1 * 7/2012 Carbone ..... A47D 13/02 297/183.1
2015/0223591 A1 * 8/2015 Owens ..... A45F 5/10 16/430
2016/0143371 A1 * 5/2016 Mazzanti ..... A41D 1/215 2/69

* cited by examiner

*Primary Examiner* — Justin M Larson
(74) *Attorney, Agent, or Firm* — Jason T. Daniel, Esq.; Daniel Law Offices, P.A.

(57) ABSTRACT

A hands-free carrying device includes an elongated main body member having a top wall, a bottom wall, a first end, a second end and a pair of side walls. The bottom wall is curved to receive and engage the forearm of a user, and a connector is positioned along the top wall. The connector forms a releasable loop for engaging the handle of an infant carrier perpendicularly relative to the user's forearm and positions the seating area of the infant carrier parallel to the user's forearm. The device includes a moisture wicking outer layer, a padded middle layer, and a rigid inside layer. The outer layer is removeable, and the connectors are secured directly onto the inside layer and extend through openings in the middle and outer layers.

13 Claims, 3 Drawing Sheets

HANDS-FREE CARRYING DEVICE

TECHNICAL FIELD

The present invention relates generally to devices for carrying elements or objects, and more particularly to a hands-free carrying device.

BACKGROUND

The statements in this section merely provide background information related to the present disclosure and may not constitute prior art.

Parents of babies and young children often utilize an infant carrier when transporting a child from one location to another. As is known in the art, such carriers include a reclined seating area for a child, an articulating handle that extends over the seating area, and a latching mechanism for securement onto a car seat base when traveling in a motor vehicle.

Although incredibly useful, these carriers are quite heavy, and many parents often struggle to carry the device and child for long periods of time. Moreover, when grasping the carrier's handle with one or both hands, it is common for the carrier to swing wildly with each step the parent takes, thus risking potential injury or motion sickness to the child inside. In other instances, parents will place a portion of the carrier's handle in the crux of their elbow and attempt to carry the device using their forearm and biceps instead. Although this reduces the swinging of the carrier, the pressure from the handle often causes pain to the user's arm, and it is quite common for the handle and carrier to slide/rotate sideways, which can be quite dangerous if the child is not strapped into the seat, as they can fall from the carrier.

Accordingly, it would be beneficial to provide a hands-free carrying device that can allow a user to carry any number of different items without suffering from the drawbacks described above.

SUMMARY OF THE INVENTION

The present invention is directed to a hands-free carrying device. One embodiment of the present invention can include an elongated main body member having a top wall, a bottom wall, a first end, a second end and a pair of side walls. The main body can include a curved bottom wall that is designed to receive and engage the forearm of a user, and a connector that is positioned along the top wall.

The connector can form a releasable loop for engaging the handle of an infant carrier and positioning the handle in a perpendicular orientation to the forearm of the user and for positioning the seating area of the infant carrier in a parallel orientation to the forearm of the user.

The device can include a layered construction wherein the outer layer includes a moisture wicking material, the middle layer includes impact resistant padding, and the inside layer includes a rigid core construction. The outer layer can be removeable, and the connectors can be secured directly onto the inside layer and can extend through openings in the middle and outer layers.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
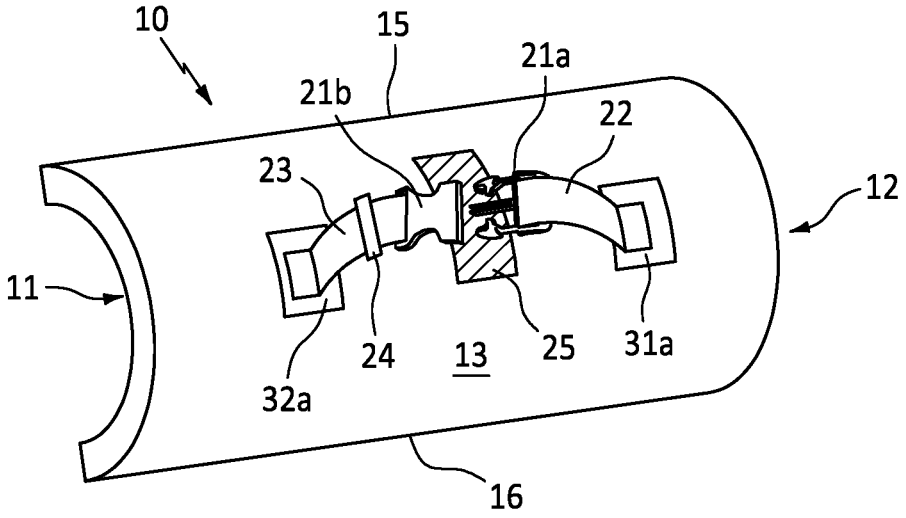
FIG. 1 is a top perspective view of the hands-free carrying device, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described herein, a "high friction material" can include any number of different materials that, when secured to the main body, provide a greater level of resistance to movement than what the construction material of the main body affords. Several nonlimiting examples of high friction materials include, rubber and silicon carbide, for example FIGS. 1-4 illustrate one embodiment of a hands-free carrying device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Although described and illustrated for use with an infant carrier, the inventive concepts are not to be construed as limiting to any particular use or industry. To this end, the carrying device can be used to engage and carry any type of object having a handle, lever, or other such surface to which the device can be secured.

Figure 2:
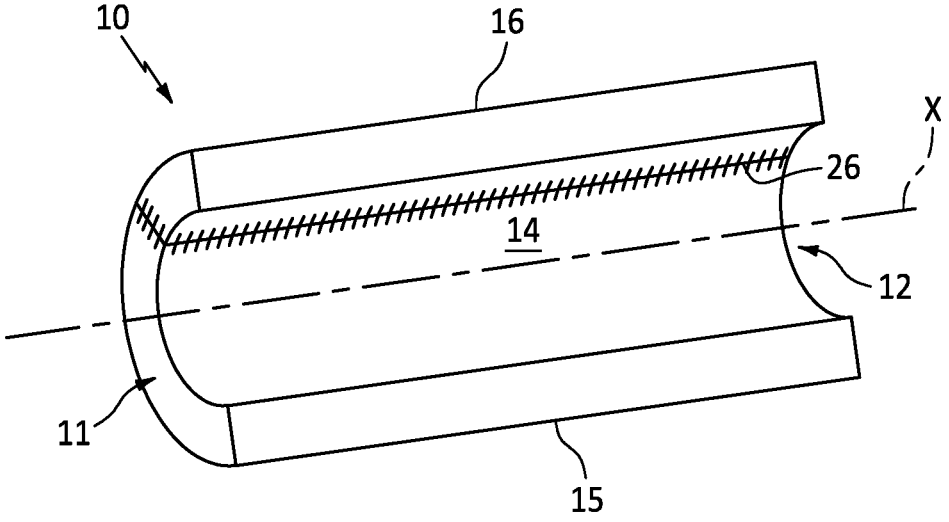
FIG. 2 is a bottom perspective view of the hands-free carrying device, in accordance with one embodiment of the invention.
Figure 3:
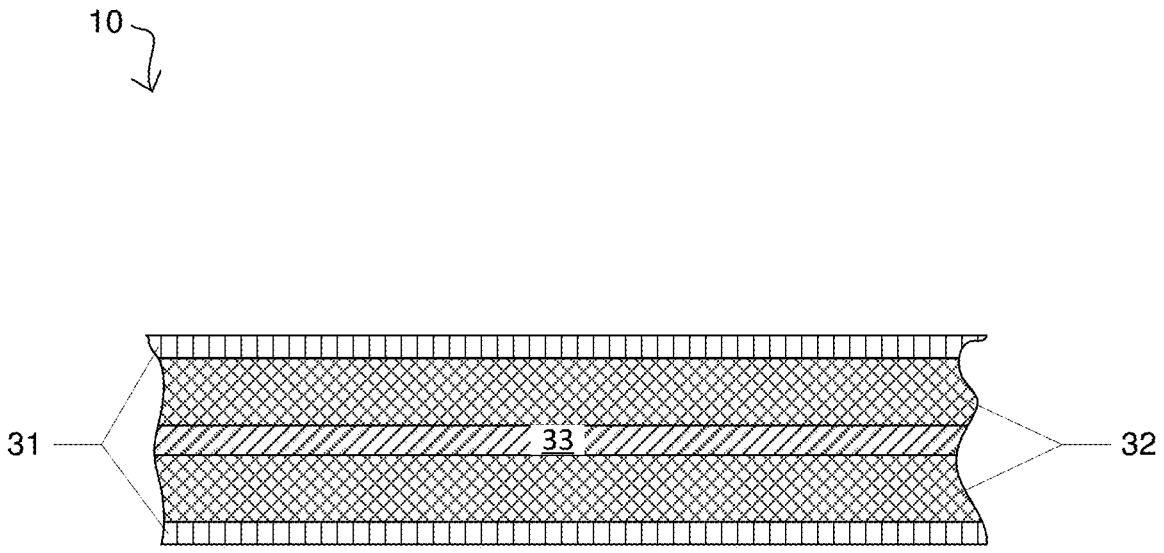
FIG. 3 is a partial cutout cross section view of the layered construction of the main body of the hands-free carrying device, in accordance with one embodiment of the invention.

As shown best at FIGS. 1 and 2, one embodiment of the device 10 can include an elongated main body member having a first end 11, a second end 12, a top surface 13, a bottom surface 14, and a pair of side walls 15 and 16. The bottom surface 14 can preferably include a generally concave shape between the side walls 15 and 16 extending along the length/major axis X of the device, so as to conform to and engage the forearm of a user.

The top surface can include a connector for engaging and positioning the handle of an infant carrier in a perpendicular orientation to the forearm of the user, which thus results in the seating area of the carrier being positioned parallel to the orientation of the user's forearm at all times.

In the preferred embodiment, the connector can include a releasable loop that is formed by a male buckle 21*a* and female buckle 21*b* that extend outward from the top surface 13 via a pair of straps 22 and 23. Such an orientation forming a loop which can be opened and closed to receive the secondary object. At least one of the straps can include an adjustment mechanism 24 to permit the user to adjust the size of the loop formed by the connector, so as to allow the user to tighten the loop around the handle or other such object in order to prevent movement of the same.

In one embodiment, one or more resilient and generally malleable stoppers 25 can be positioned along the top surface 13, preferably at a location directly beneath the buckles. Each of the stoppers can be constructed from a high friction material and can function to reduce or prevent the external device secured by the connector from sliding or moving perpendicularly relative to the device. When in use with a carrier, the stopper is specifically designed to prevent the carrier handle from sliding sideways and causing the carrier to rotate such that the child could fall out of the same.

Of course, the inventive concepts are not to be construed as limited to using a connector having a buckle and strap combination, as any number of other types of connectors capable of removably engaging a secondary object can also be provided.

In the preferred embodiment, the main body of the device can include a layered construction, wherein each layer performs a different and specific function. As illustrated in cross sectional FIG. 3, the main body of the device can preferably include an outside layer 31, a middle layer 32 and an inside layer 33.

As described herein, the outside layer 31 can function to make direct contact with both a human user and the secondary object. To this end, the outside layer may be constructed from any number of different materials, and can include any number of different markings, designs and/or other type of indicia. In the preferred embodiment, the outside layer can be constructed from a moisture wicking fabric such as high-tech polyester, for example, that actively draws sweat and moisture away from the arm of the user, so as to prevent the device from sliding along the arm of the user when in use. Of course, any number of other types of materials and fabrics that are suitable for direct contact with the human body such as cotton, wool, or linen, for example, are also contemplated.

The middle layer 32 can function to protect and cushion the user's arm when using the device to carry a secondary object. In the preferred embodiment, the middle layer can include, comprise or consist of one or more sheets of malleable and impact resistant polyurethane foam or other such cushioning material. Of course, any number of other soft and malleable materials are also contemplated.

The inside layer 33 can form the overall shape of the main body and can be curved along the bottom end such that the bottom surface 14 forms a complementary shape thereto. The inside layer can function to spread out the weight of the external object longitudinally along the length of the device, so as to protect the users' arm from bearing all of the weight of the object where it directly engages the device 10 perpendicularly. Such a feature being particularly important as this greatly reduces soreness and fatigue when carrying heavy items for long periods of time using the device.

As such, the inside layer will preferably be constructed from a material that is, for example, relatively strong and stiff for its weight. Several nonlimiting examples include but are not limited to various metals or metal alloys (e.g., aluminum, steel, titanium, or alloys thereof), plastic/polymers (e.g., high-density polyethylene (HDPE), rigid polyvinyl chloride (PVC)), and/or various composite materials (e.g., carbon fibers in a polymer matrix, fiberglass, etc.,).

In one embodiment, the outside layer 31 can be removably secured over the middle and inside layers. To this end, the outside layer can include a releasable seam 26 such as elongated strips of hook and loop material, or other such connectors along the length of the layer. In such an embodiment, the base portions of the straps 22 and 23 or other primary connectors can be directly secured onto the inside layer 33 and can extend through openings 32*a* and 31*a* in the middle and outside layers, respectively. Such a feature advantageously allowing the outer layer to be independently removed so as to be laundered and/or replaced with a different material or different indicia, for example.

Figure 4:
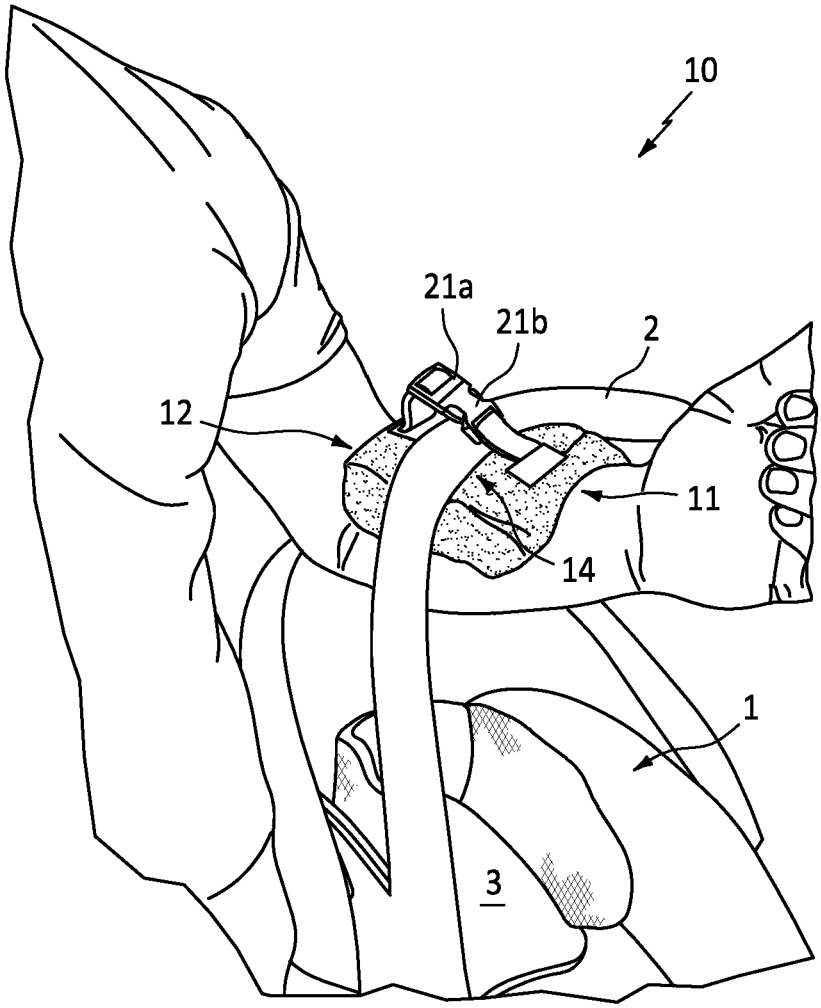
FIG. 4 is perspective view of the hands-free carrying device in operation, in accordance with one embodiment of the invention.

FIG. 4 illustrates one embodiment of the device 10 in operation with a child carrier 1. As shown, the handle 2 can be positioned perpendicular to the length of the device, and the buckles 21*a* and 21*b* can be joined together such that the straps are tightened about the circumference of the handle. When so positioned, the user can position their arm along the curved bottom surface of the device and can easily lift and transport the carrier (or other connected object) in a secure manner wherein the weight of the object is spread out along the length of the user's arm.

Moreover, due to the perpendicular orientation of the handle relative to the length of the device and the user's forearm, the seating area 3 will be parallel to the user's forearm and will face the same direction as the user's forearm at all times without shifting, sliding or otherwise rotating as the user walks and moves. Such a feature being important to prevent rapid movements or angular forces from causing the child to fall out of the seat.

Although dimensions are not critical, in the preferred embodiment, the device can include a length along the major axis (e.g., distance from first end 11 to second end 12) of about 6 inches, and a width (e.g., distance between sides 15 and 16) of about 3 inches. These dimensions being specifically chosen so as to accommodate average sized adult arms such that the device can extend along the forearm from the elbow to a location just short of the wrist. This is particularly important so as to ensure the device does not interfere with the ability of the user to move their wrist or hand. Of course, other dimensions are also contemplated.

As described herein, one or more elements of the hands-free carrying device 10 can be secured together utilizing any number of known attachment means. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A hands-free carrying device, comprising:

an elongated main body member having a top wall, a bottom wall, a first end, a second end and a pair of side walls, said main body further including a layered construction having an outside layer, a middle layer, and an inside layer, wherein the outside layer forms the top wall and bottom wall;

a connector that extends outward from the top wall, said connector being configured to engage a secondary object and secure the secondary object onto the top wall; and a stopper that is positioned between the top wall and the connector; wherein the bottom wall includes a shape and size that is configured to engage a forearm of a user, and wherein the inside layer is constructed from a rigid material, and the outside layer is removably positioned over each of the inside layer and the middle layer.

2. The device of claim 1, wherein the top wall includes a convex shape extending between the pair of side walls.

3. The device of claim 2, wherein the bottom wall includes a concave shape extending between the pair of side walls.

4. The device of claim 1, wherein the outside layer is constructed from a fabric material.

5. The device of claim 1, wherein the outside layer is constructed from a moisture wicking fabric material.

6. The device of claim 1, wherein the middle layer is constructed from an impact absorbing material.

7. The device of claim 6, wherein the middle layer is constructed from foam.

8. The device of claim 1, wherein the inside layer is constructed from plastic.

9. The device of claim 1, wherein the stopper is constructed from a resilient, malleable and high friction material.

10. The device of claim 1, further comprising:

a releasable seam that is positioned along the outside layer of the main body.

11. The device of claim 1, wherein the outside layer includes at least one aperture.

12. The device of claim 11, wherein the connector is secured directly to the rigid inside layer and a portion of the connector extends through the at least one aperture.

13. The device of claim 1, wherein the main body includes a length of about six inches.

* * * * *